US010158205B2

(12) United States Patent
Wen et al.

(10) Patent No.: US 10,158,205 B2
(45) Date of Patent: Dec. 18, 2018

(54) ELECTRIC CONNECTOR AND ILLUMINATING DEVICE COMPRISING THE ELECTRIC CONNECTOR

(71) Applicant: LEDVANCE GmbH, Garching bei München (DE)

(72) Inventors: Haitao Wen, Guangdong (CN); Jun Liu, Guangdong (CN)

(73) Assignee: LEDVANCE GMBH, Garching bei Munchen (DE)

( * ) Notice: Subject to any disclaimer, the term of this patent is extended or adjusted under 35 U.S.C. 154(b) by 0 days.

(21) Appl. No.: 15/545,892

(22) PCT Filed: Nov. 9, 2015

(86) PCT No.: PCT/EP2015/076032
§ 371 (c)(1),
(2) Date: Jul. 24, 2017

(87) PCT Pub. No.: WO2016/119935
PCT Pub. Date: Aug. 4, 2016

(65) Prior Publication Data

US 2017/0365967 A1 Dec. 21, 2017

(30) Foreign Application Priority Data

Jan. 27, 2015 (CN) ..... 2015 1 0039430

(51) Int. Cl.

| | |
|---|---|
| ***H01R 33/08*** | (2006.01) |
| ***H01R 13/24*** | (2006.01) |
| ***H01R 33/96*** | (2006.01) |
| ***F21K 9/272*** | (2016.01) |
| ***F21V 23/06*** | (2006.01) |

(Continued)

(52) U.S. Cl.
CPC ..... *H01R 33/0845* (2013.01); *F21K 9/272* (2016.08); *F21V 23/06* (2013.01); *H01R 13/2421* (2013.01); *H01R 13/4538* (2013.01); *H01R 33/0836* (2013.01); *H01R 33/96* (2013.01); *H01R 13/4532* (2013.01); *H01R 24/005* (2013.01)

(58) Field of Classification Search
CPC ..... H01R 33/08; H01R 33/0809; H01R 33/0818; H01R 33/0827; H01R 33/0836; H01R 33/0845; H01R 33/0854; H01R 33/0863; H01R 33/0872; H01R 33/0881; F21V 25/04
USPC ..... 439/700, 824, 10, 699.1, 612
See application file for complete search history.

(56) References Cited

FOREIGN PATENT DOCUMENTS

| | | |
|---|---|---|
| GB | 2280550 A | 2/1995 |
| WO | 2012131522 A1 | 10/2012 |

*Primary Examiner* — Ross Gushi
(74) *Attorney, Agent, or Firm* — Hayes Soloway PC

(57) ABSTRACT

The present invention relates to an electric connector and an illuminating device comprising this electric connector, wherein the electric connector comprises a housing and an end cap connected to the housing, wherein an conductor which can be connected to a power supply is arranged in the end cap, wherein the conductor comprises a stationary part and a movable part, wherein the conductor is rotatable relative to the housing along with the end cap from a first position to a second position, wherein the movable parts at least partially retract into the stationary part in the first position, and at least one movable part extends out of the stationary part in the second position so as to be in electric connection with a power consumption component arranged in the housing.

11 Claims, 4 Drawing Sheets

(51) Int. Cl.
*H01R 13/453* (2006.01)
*H01R 24/00* (2011.01)

ELECTRIC CONNECTOR AND ILLUMINATING DEVICE COMPRISING THE ELECTRIC CONNECTOR

TECHNICAL FIELD

The present invention relates to an electric connector, especially for an illuminating device, and to an illuminating device comprising this electric connector.

BACKGROUND ART

The electric connectors are often arranged at both ends of a generally used tubular light-emitting device for connection with the power supply. In order to improve the safety of the light-emitting device, the electric connectors usually will be designed with the two-step safety operation function. After the lamp tube installed with the electric connectors is manually connected to an adapter with a power supply and is secured, the electric connectors need to be further operated manually so as to switch on the electrical connection between the power supply and the lamp tube. The electric connector used for a light-emitting device in the prior art often uses, for instance, an electric, magnetic, or thermal switching means so as to switch on and off the electrical connection between the power supply and the lamp tube. In one of the prior art, for example, a mechanical switching means is used, after the lamp tube with the electric connectors are installed in the socket, the buttons on the electric connectors should be manually pressed to turn on the switches in the electric connectors so as to enable the electrical connection between the electric socket and the lamp tube. The above electric connectors put forward in the prior art usually need additional manual operation for arranging the electric connectors, after the electric connectors are completely installed and secured to the adapter, so as to turn on or off the light source connected to the electric connector.

SUMMARY OF THE INVENTION

The present invention provides a novel electric connector, especially an electric connector for an illuminating device, and relates to an illuminating device comprising this electric connector. The electric connector according to the present invention can simply realize the two-step safety operation so as to solve the safety problem about installing an illuminating device. Besides, the electric connector according to the present invention provides a rotational operation mode such that the two-step safety operation is realized via the rotational operation so as to allow energizing of a power consumption component in the lamp tube via the electric connector.

One of the objects of the present invention is realized by such an electric connector that comprises a housing and an end cap connected to the housing, wherein at least one conductor which can be connected to a power supply is provided in the end cap, wherein the conductor comprises a stationary part and a movable part, wherein the conductor is rotatable relative to the housing along with the end cap from a first position to a second position, wherein the movable part at least partially retracts into the stationary part in the first position, and at least one movable part extends out of the stationary part in the second position so as to be in electric connection with a power consumption component provided in the housing.

With the electric connector according to the present invention, it can realize that the conductor on the end cap can be in electric connection with the power consumption component arranged in the housing after the two steps of operation of pressing and rotating. In other words, before the pressing or rotating operation, the conductor would not be in electric connection with the power consumption component.

According to a preferred example of the present invention, the housing comprises a stop structure, wherein after the end cap is rotated to the second position, the stop structure removes obstruction to the movable part such that at least one movable part is movable relative to the stationary part and in electric connection with the power consumption component. Before the end cap is rotated to the second position, the stop structure makes it impossible for the movable part of the conductor to move relative to the stationary part, that is, in this situation, the conductor would not be in contact with the power consumption component in the housing.

Further preferably, the stop structure is configured as a platform with holes, and the respective movable part can move through the respective hole to be in electric connection with the power consumption component. Only after the end cap is rotated to the second position, can the movable part of the conductor move relative to the stationary part and out of the stationary part and pass through the hole to be in connection with the power consumption component.

Advantageously for the solution of the present invention, at least two such conductors are provided, movable parts of one of the conductors and of the other conductors are connected with the power consumption component by extending different distances from respective stationary parts through the holes. Since the electric conductors of the power consumption component arranged in the housing are inserted with different lengths into the respective holes of the platform, the movable parts of the two conductors can be in contact with the respective electric conductors of the power consumption component by extending different lengths, such that the electric connection between the power supply and the power consumption component is realized via the conductors.

Preferably, with the insertion of the movable part into the hole, the end cap is locked relative to the housing. After the end cap is rotated to the second position, in a situation that the movable part of the conductor is inserted into the hole, the end cap can no longer rotate relative to the housing. Particularly, in a situation that a torsional spring is provided between the end cap and the housing, the arrangement of insertion of the movable part into the hole can prevent occurrence of undesired automatic rotation of the end cap under the effect of the torsional spring, especially after installation of the electric connector in the electric socket.

It is preferably put forward in an example of the present invention that a boss is provided on an inner surface of the end cap, and a slot is provided on an outer surface of the housing, wherein when the end cap is moved, the boss can move out of the slot so as to allow rotation of the end cap relative to the housing.

Preferably, the torsional spring is provided between the end cap and the housing so as to supply a torsional force applied on the end cap. In a situation that the torsional spring is provided, when the electric connector is removed from the electric socket or the electric connection between the electric connector and the socket is switched off, the end cap can be reset as it automatically rotates from the second position to the first position by means of the torsion of the torsional spring, thus omitting redundant manual operation.

Advantageously, the electric connector further comprises a retainer keeping the torsional spring in the housing, wherein the retainer transfers the torsion supplied by the torsional spring to the end cap.

Further preferably, a limiting structure is provided on an outer surface of the housing so as to define a rotating direction of the end cap relative to the housing. This limiting structure effectively provides a fool-proof measure so as to avoid misoperation caused by rotating the end cap by an operator in an undesired direction Preferably, the platform is formed integrally on an inner wall of the housing. The integral arrangement efficiently forms a simple and stable structure of the housing.

Preferably, a spring is provided between the stationary part and the movable part. By means of this spring, the movable part can extend out of the stationary part when it is not obstructed by the stop structure, and can retract back into the stationary part when it is extruded and again obstructed by the stop structure.

The other object of the present invention is realized by such an illuminating device that comprises at least one electric connector according to the above-mentioned and a power consumption component arranged in the housing of the electric connector. The illuminating device according to the present invention thus has an electric connector with two-step safety operation function, accordingly, the utilization safety of the illuminating device is improved.

BRIEF DESCRIPTION OF THE DRAWINGS

The accompanying drawings constitute a part of the present description and are used to provide further understanding of the present invention. Such accompanying drawings illustrate the embodiments of the present invention and are used to describe the principles of the present invention together with the description. In the accompanying drawings the same components are represented by the same reference numbers. As shown in the drawings.

DETAILED DESCRIPTION OF THE EMBODIMENTS

Figure 1:
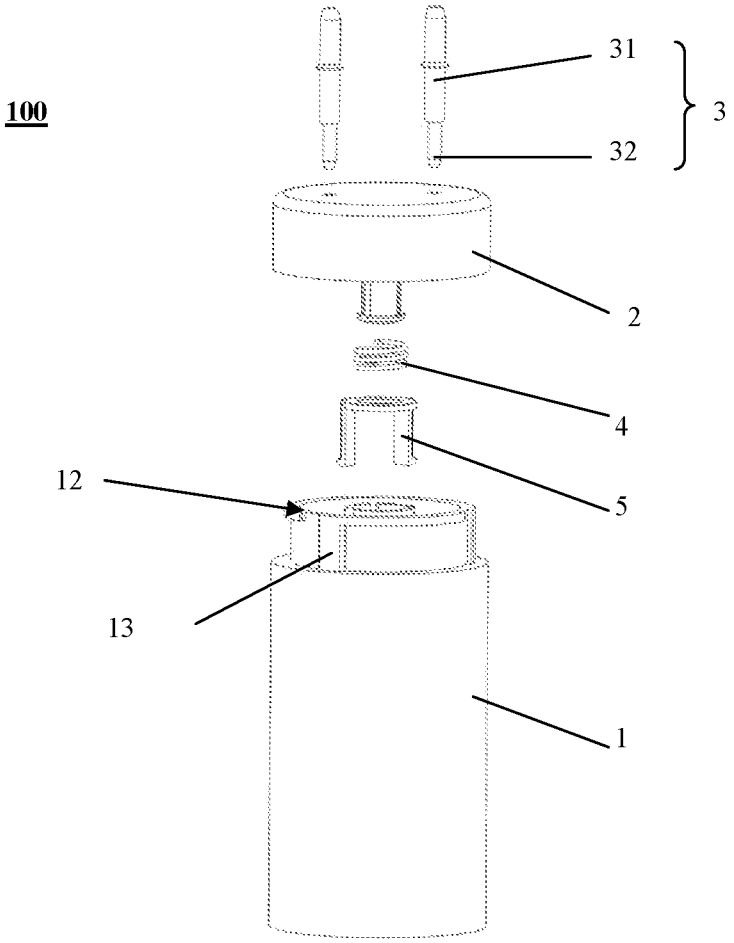
FIG. 1 shows an exploded schematic diagram of an electric connector according to the present invention.

FIG. 1 shows an exploded schematic diagram of an electric connector 100 according to the present invention. The electric connector 100 according to the present invention comprises an end cap 2, conductors 3 inserted into the end cap 2, and a housing 1 connected to the end cap 2, wherein a torsional spring 4 and a retainer 5 keeping the torsional spring 4 in the housing 1 are provided between the end cap 2 and the housing 1. The respective electric connector 3 according to the present invention comprises a stationary part 31 and a movable part 32 which can move relative to this stationary part 31, and such a specific structure can be seen in FIG. 2.

Figure 3:
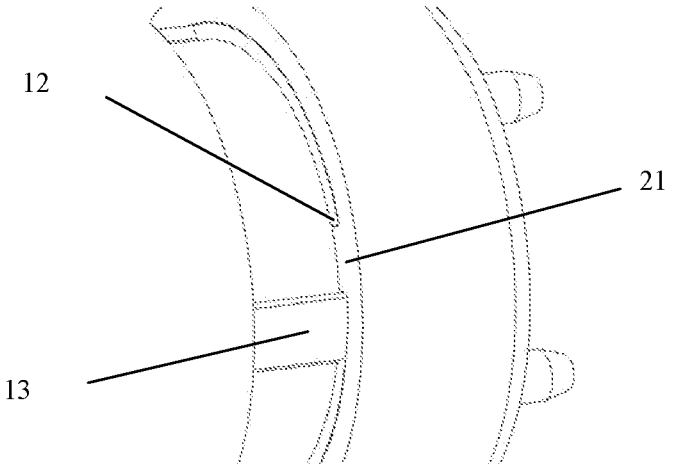
FIG. 3 shows an enlarged local schematic diagram of an electric connector according to the present invention.

Besides, as is shown in FIG. 3, a boss 21 is arranged on an inner surface of the end cap, and a slot 12 corresponding to the boss 21 is arranged on an outer surface of the housing 1, accordingly, when the boss 21 of the end cap 2 is located in the slot 12, the end cap 2 cannot rotate relative to the housing 1 under the action of an external force. On the outer surface of the housing 1, a limiting structure 13 is further provided for limiting a moving direction of the boss 21.

When the boss 21 of the end cap 2 moves out of the slot 12, the end cap 2 can rotate relative to the housing 1 with the action of an external force, and the boss 21 only can rotate towards a direction defined by the limiting structure 13. This advantageously achieves a fool-proof arrangement and avoids damage of the misoperation of an operator to the electric connector 100 or an illuminating device comprising this electric connector 100.

Figure 2:
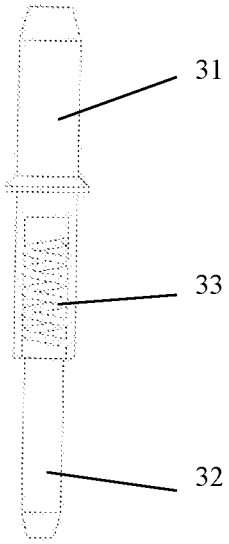
FIG. 2 shows a cross-sectional schematic diagram of a conductor according to the present invention.

FIG. 2 shows a cross-sectional schematic diagram of a conductor 3 according to the present invention. The respective conductor 3 according to the present invention comprises the stationary part 31 and the movable part 32 which can be at least partially received in this stationary part 31, wherein a spring 33 is provided between the stationary part 31 and the movable part 32. When the movable part 32 is pressed by a stop structure 11 configured as a platform (see FIG. 4), the movable part 32 retracts into the stationary part 31 against the spring force of the spring 33. Thus, the entire length of the conductor 3 is reduced. When the movable part 32 is not pressed by the stop structure 11, the movable part 32 can extend out of the stationary part 31 with the aid of the spring force of the spring 33.

FIG. 3 shows an enlarged local schematic diagram of the electric connector 100 according to the present invention. As can be seen from FIG. 3, when the end cap 2 is not pressed, the boss 21 of the end cap 2 is still located in the slot 12 on the outer surface of the housing 1, while once under the action of an external force, the end cap 2 can move relative to the housing 1 such that the boss 21 can move out of the slot 12, at this point, the boss 21 enters into a track on the outer surface of the housing 1. Accordingly, the boss 21 can move in this track when an external force is applied on the end cap 2 so as to thereby allow rotation of the end cap 2 relative to the housing 1. It is further shown in FIG. 3 that the limiting structure 13 is arranged on the outer surface of the housing 1, and the limiting structure 13 can prevent the boss 21 from moving in the track in an undesired direction so as to define a rotating direction of the end cap 2 relative to the housing 1.

Figure 4:
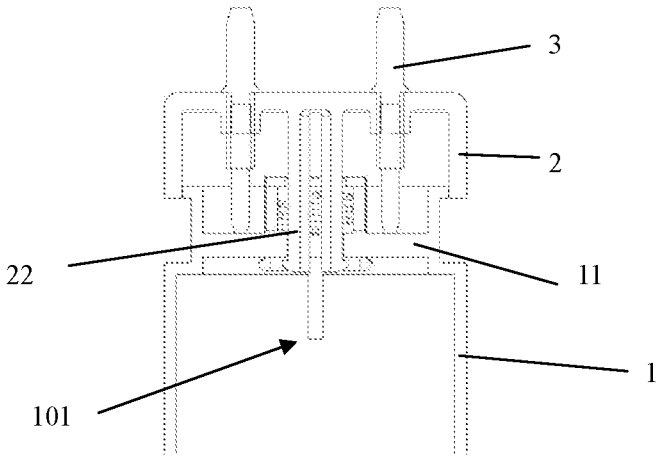
FIG. 4 shows a cross-sectional schematic diagram of an electric connector according to the present invention when an end cap is not operated.

FIG. 4 shows a cross-sectional schematic diagram of the electric connector 100 according to the present invention when the end cap 2 is not operated. The end cap 2 is installed onto the housing 1 by inserting its pivotal axis 22 into the platform. A power consumption component 101 such as a circuit board is arranged in the housing 1, and the electric conductors 1011 of the circuit board are inserted into the platform. When the end cap 2 is not operated, i.e., when the end cap 2 is not pressed, the conductors 3 have an unchanged length, the tops of the movable parts 32 of the conductors 3 press against a surface of the platform, and the movable parts 32 do not retract back into the stationary parts 31 due to the pressing of the platform.

Figure 5:
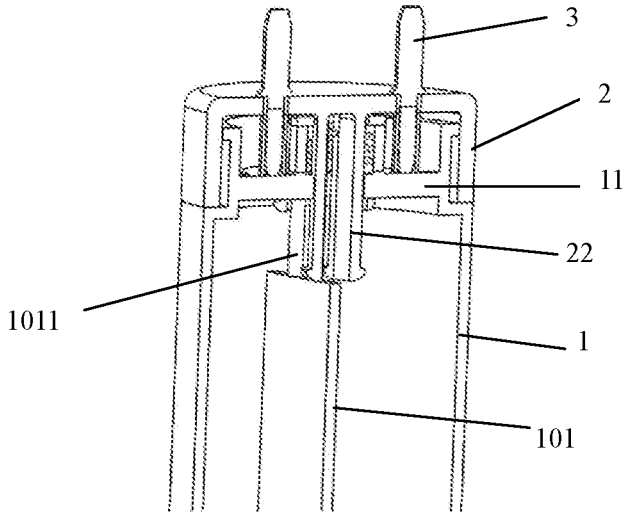
FIG. 5 shows a cross-sectional schematic diagram of an electric connector according to the present invention when a first step of operation is performed on an end cap.

FIG. 5 shows a cross-sectional schematic diagram of the electric connector 100 according to the present invention when a first step of operation is performed on the end cap 2. When the end cap 2 is operated, i.e., when the end cap 2 is pressed but not rotated, the end cap 2 moves relative to the housing 1 in a predetermined direction, at this point, the tops of the movable parts 32 of the conductors 3 still press against the surface of the platform, but retract back into the stationary part 31 due to the pressing of the platform, thus, the entire length of the conductors 3 is reduced.

Figure 6:
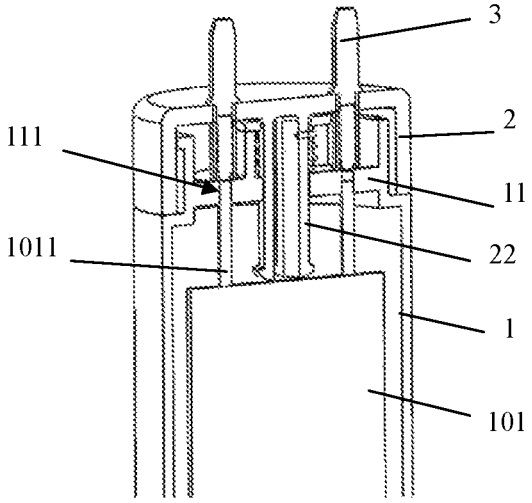
FIG. 6 shows a cross-sectional schematic diagram of an electric connector according to the present invention when a second step of operation is performed on an end cap.

FIG. 6 shows a cross-sectional schematic diagram of the electric connector 100 according to the present invention when a second step of operation is performed on the end cap 2. When the end cap 2 is further operated, i.e., when the end cap 2 is further rotated about the pivotal axis 22 of the end cap 2 in a case that the end cap 2 is pressed, the conductors 3 can rotate along with the end cap 2 about the pivotal axis 22 of the end cap 2. When the end cap 2 is rotated from a first position to a second position, the tops of the movable parts 32 of the conductors 3 arrive at the position of the holes 111 provided on the platform. According to the depth of the electric conductors 1011 of the power consumption component 101 inserted into the holes 111, the movable parts 32 extend correspondingly out of the stationary parts 31 and insert into the holes 111, and thus in contact with the electric conductors 1011 of the power consumption component 101 in the holes 111. As the electric conductors 1011 of the power consumption component 101 are inserted into the holes 111 with different depths, the distances of the movable parts 32 of the conductors 3 mounted in the end cap 2 extending from the stationary parts 31 are also different. According to a preferred embodiment of the present invention, the lengths by which the electric conductors 1011 of the power consumption component 101 extend into the holes 111 have a difference of 1.5 mm.

Thus, according to such arrangement, by means of the movable part 32 inserted into the hole 111, the end cap 2 is locked relative to the housing 1 and can no longer rotate relative to the housing 1. However, when the electric connector 100 is pulled out from a receptacle, the end cap 2 moves away from the housing 1 under the action of the spring 33 of the conductor 3, and under a further action of the torsional force of the torsional spring, the end cap 2 can rotate again relative to the housing 1 and can rotate back to its initial position.

The above is merely preferred embodiments of the present invention but not to limit the present invention. For the person skilled in the art, the present invention may have various alterations and changes. Any alterations, equivalent substitutions, improvements, within the spirit and principle of the present invention, should be covered in the protection scope of the present invention.

REFERENCE SIGNS

1 housing
2 end cap
3 conductor
4 torsional spring
5 retainer
11 stop structure
12 slot
13 limiting structure
21 boss
22 pivotal axis of end cap
31 stationary part
32 movable part
33 spring
100 electric connector
101 power consumption component
111 hole
1011 electric conductors of the power consumption component.

What is claimed is:

1. An electric connector comprising a housing having a stop structure and an end cap connected to the housing, wherein at least one conductor connectable to a power supply is arranged in the end cap, characterized in that the conductor comprises a stationary part that is stationary relative to the end cap and a movable part that is movable relative to the end cap, wherein the conductor and the end cap are rotatable relative to the housing from a first position to a second position, wherein the movable part at least partially retracts into the stationary part in the first position, and the movable part extends out of the stationary part in the second position so as to be in electric connection with a power consumption component arranged in the housing, wherein after the end cap is rotated to the second position, the stop structure removes obstruction to the movable part such that at least one of the movable parts is movable relative to the stationary part and in electric connection with the power consumption component.

2. The electric connector according to claim 1, characterized in that the stop structure is configured as a platform with holes, and the movable parts are movable respectively through the holes to be in electric connection with the power consumption component.

3. The electric connector according to claim 2, characterized in that at least two such conductors are provided, wherein the movable parts of one of the conductors and of the other conductors are connected with the power consumption component by extending different distances from respective stationary parts through the holes.

4. The electric connector according to claim 2, characterized in that with insertion of the movable part into the hole, the end cap is locked relative to the housing.

5. The electric connector according to claim 2, characterized in that the platform is formed integrally on an inner wall of the housing.

6. An electric connector comprising a housing having a stop structure and an end cap connected to the housing, wherein at least one conductor connectable to a power supply is arranged in the end cap, characterized in that the conductor comprises a stationary part that is stationary relative to the end cap and a movable part that is movable relative to the end cap, wherein the conductor and the end cap are rotatable relative to the housing from a first position to a second position, wherein the movable part at least partially retracts into the stationary part in the first position, and the movable part extends out of the stationary part in the second position so as to be in electric connection with a power consumption component arranged in the housing, further comprising a boss on an inner surface of the end cap, and a slot on an outer surface of the housing, and whereby when the end cap is moved, the boss can be moved out of the slot to allow rotation of the end cap relative to the housing.

7. The electric connector according to claim 6, characterized in that a torsional spring is provided between the end cap and the housing so as to supply torsional force applied on the end cap.

8. The electric connector according to claim 7, characterized in that the electric connector further comprises a retainer keeping the torsional spring in the housing, wherein the retainer transfers the torsional force supplied by the torsional spring to the end cap.

9. An electric connector comprising a housing having a stop structure and an end cap connected to the housing, wherein at least one conductor connectable to a power supply is arranged in the end cap, characterized in that the conductor comprises a stationary part that is stationary relative to the end cap and a movable part that is movable relative to the end cap, wherein the conductor and the end cap are rotatable relative to the housing from a first position to a second position, wherein the movable part at least partially retracts into the stationary part in the first position, and the movable part extends out of the stationary part in the second position so as to be in electric connection with a power consumption component arranged in the housing, wherein a limiting structure is provided on an outer surface of the housing so as to define a rotating direction of the end cap relative to the housing.

10. An electric connector comprising a housing having a stop structure and an end cap connected to the housing, wherein at least one conductor connectable to a power supply is arranged in the end cap, characterized in that the conductor comprises a stationary part that is stationary relative to the end cap and a movable part that is movable relative to the end cap, wherein the conductor and the end cap are rotatable relative to the housing from a first position to a second position, wherein the movable part at least partially retracts into the stationary part in the first position, and the movable part extends out of the stationary part in the second position so as to be in electric connection with a power consumption component arranged in the housing, characterized in that a spring is provided between the stationary part and the movable part.

11. An illuminating device, characterized by comprising at least one electric connector according to claim 10 and a power consumption component arranged in the housing of the electric connector.

* * * * *